United States Patent [19]

Medlin et al.

[11] 4,415,035

[45] Nov. 15, 1983

[54] METHOD FOR FRACTURING A PLURALITY OF SUBTERRANEAN FORMATIONS

[75] Inventors: William L. Medlin, Dallas; Malcolm K. Strubhar, Irving; John L. Fitch, Dallas, all of Tex.

[73] Assignee: Mobil Oil Corporation, New York, N.Y.

[21] Appl. No.: 359,398

[22] Filed: Mar. 18, 1982

[51] Int. Cl.[3] ..... E21B 43/26

[52] U.S. Cl. ..... 166/308; 166/250

[58] Field of Search ..... 166/250, 280, 308

[56] References Cited

U.S. PATENT DOCUMENTS

| | | | |
|---|---|---|---|
| 3,028,914 | 4/1962 | Flickinger | 166/308 |
| 3,427,652 | 2/1969 | Seay | 166/250 |
| 3,547,198 | 12/1970 | Slusser | 166/308 |
| 3,586,105 | 6/1971 | Johnson et al. | 166/250 |
| 4,137,182 | 1/1979 | Golinkin | 166/308 |

OTHER PUBLICATIONS

A Continuous Multistage Fracturing Technique, Webster et al., Journal of Petroleum Technology, vol. 17, No. 6, Jun. 1965.

*Primary Examiner*—Stephen J. Novosad
*Assistant Examiner*—William P. Neuder
*Attorney, Agent, or Firm*—Alexander J. McKillop; James F. Powers, Jr.; George W. Hager, Jr.

[57] ABSTRACT

A well casing penetrating a plurality of subterranean hydro carbon-bearing formations is perforated adjacent select ones of such hydrocarbon-bearing formations that are expected to exhibit at least a minimum pressure increase during fracturing operations. A fracturing fluid is pumped down the well through the perforations, and into the formations so as to fracture each of the select formations during a single fracturing operation.

4 Claims, 1 Drawing Figure

METHOD FOR FRACTURING A PLURALITY OF SUBTERRANEAN FORMATIONS

BACKGROUND OF THE INVENTION

This invention relates to the fracturing of subterranean formations and more particularly to a method for forming fractures in a plurality of vertically disposed hydrocarbon-bearing formations communicating with a well equipped with a casing penetrating a subterranean earth formation.

Hydraulic fracturing techniques have been extensively used for treating subterranean hydrocarbon-bearing formations. Generally, perforations or slots are formed in well casing adjacent a formation to be fractured. Hydraulic fluid is then pumped down the well through the perforations and into contact with the formation. Hydraulic pressure is applied in a sufficient amount to fracture the formation and thereafter fluid is pumped into the fracture to propogate the fracture into the formation. It is generally accepted that, at depth, vertical fractures are formed in most formations when a sufficiently high hydrualic pressure is applied to fracture the formation. At shallower depths it is recognized that horizontal fractures may be formed in formations by applying a pressure greater than the overburden pressure.

In U.S. Pat. No. 3,028,914 to Flickinger there is described a method of producing multiple fractures from a cased well. A first fracture is made and extended into a formation. The same formation or another formation penetrated by the same well may then be fractured by plugging the mouth of the first fracture, making a number of perforations concentrated within a short section in the casing and then injecting fracturing liquid into the well and initiating a second fracture at the elevation of the second set of perforations.

In U.S. Pat. No. 3,547,198 to Slusser, there is described a method of forming two vertically disposed fractures which communicate with a cased well penetrating a subterranean formation having a preferred fracture orientation. Openings are formed through the well on opposite sides of the casing located such that they lie in a vertical plane which extends transversely of the fracture orientation. Hydraulic pressure is then applied through the openings to form a fracture at the openings on one side of the well. The openings are then temporarily sealed and hydraulic pressure is applied to form a fracture at the openings on the other side of the well. Thus, two fractures are formed adjacent opposite sides of the well and are propagated into the formation approximately parallel one to the other.

It is therefore, well known to provide temporary sealing means to well casing adjacent a first fractured earth formation so that subsequent fracturing can be carried out at other elevations within a well. Thus, by successive fracturing and sealing operations, fractures can be formed in a plurality of earth formations within a given well.

SUMMARY OF THE INVENTION

This invention is directed to a method for forming fractures in a plurality of vertically disposed hydrocarbon-bearing formations communicating with a well equipped with a casing penetrating a subterranean earth formation. It is applicable to those hydrocarbon-bearing formations penetrated by said cased well that have exhibited at least a predetermined minimum pressure increase during previous individual fracturing treatments in other nearby production wells in the areas identified. Perforations are formed in the well casing at the locations of such identified hydrocarbon-bearing formations. Hydraulic pressure is then applied through the perforations to the plurality of hydrocarbon-bearing formations simultaneously, whereby each formation is fractured in proportion to the pressure increase in such formation during the application of hydraulic pressure.

Each of such identified hydrocarbon-bearing formations preferably exhibited a pressure increase of at least 500 pounds per square inch during previous individual fracturing in a nearby well. Such pressure increase is the difference in the instantaneous shut-in pressure at the start and end of the individual fracturing operations.

DESCRIPTION OF THE PREFERRED EMBODIMENT

Figure 1:
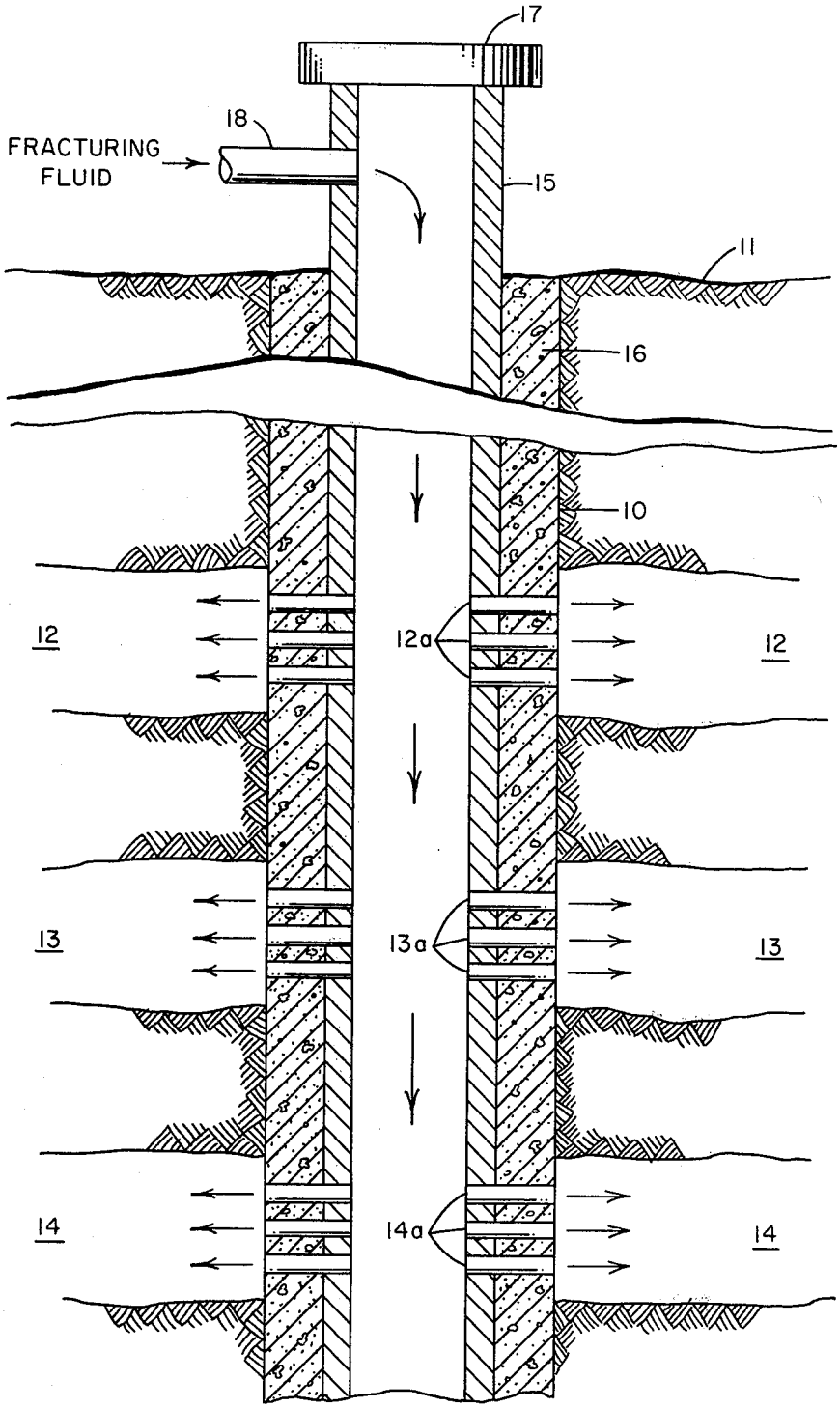
FIG. 1 is a sectional view of a well penetrating a subterranean formation having a plurality of hydrocarbon-bearing formations to be fractured by the method of the present invention.

In accordance with the present invention there is provided a method for forming fractures in a plurality of hydrocarbon-bearing formations communication with a well penetrating a subterranean earth formation during a single fracturing treatment without having to resort to separate and individual fracturing through use of mechanical packers, limited entry, ball sealers, diverting agents or other plugging means as taught in the prior art.

Referring to FIG. 1, there is shown a well 10 extending from the earth's surface 11 and penetrating a plurality of vertically separated hydrocarbon bearing formations 12–14. Well 10 is equipped with a casing 15 cemented by a cement sheath 16 and having a casing head 17. A flowline 18 extends from the casing at the surface for the introduction and withdrawals of fluids.

In carrying out the invention, the well 10 is selected and opened or perforated to those hydrocarbon bearing formations expected to exhibit at least a minimum pressure increase during fracturing operations. Such pressure increases are determined by examining those pressure increases experienced in such formations during previous individual fracturing operations in one or more wells in the nearby area. These pressure increases are the differences in the instantaneous shut-in pressures at the start and at the end of the earlier fracturing treatments in the nearby wells. Those formations exhibiting minimum pressure increases in excess of 500 psi are suitable for fracturing in accordance with the simultaneous fracturing method of the present invention.

Having selected those hydrocarbon-bearing formations, for example 12–14, which can be expected to exhibit such a minimum pressure increase during fracturing, the well casing is perforated adjacent each of such select formations, preferably with a number of perforations deemed necessary for maximum effectiveness in fracturing the formations and producing the hydrocarbons, such perforations, being shown at **12*a*, 13*a* and 14*a* in FIG. 1, adjacent formations 12–14, respectively. After perforating the well to the formations 12–14, fracturing fluid is pumped through conduit 18 and into casing 15 and applied to the formations 12–14** simultaneously through perforations 12*a*, 13*a* and 14*a*, respectively.

The fracture fluid is pumped down the well 10 at a pumping rate of at least 5 barrels per minute with a gelled fluid with viscometric properties such that the propping material to be used when mixed with the fluid does not settle at an appreciable rate, that is, for example, at less than 0.1 foot per second and preferably at less than 0.01 foot per second for low pump rates. The amount of propping material can be adjusted as desired. It may be desirable to break-down all perforations by a pre-treatment in which fluid with no proppant is pumped while dropping ball sealers. Each of the formations 12–14 will exhibit simultaneous pressure increases as the fracturing fluid is pumped down the well and into the formations.

Those of 12–14 which exhibit the slowest rate of pressure increase during such simultaneous fracturing will receive the greatest amount of fracturing fluid and will, consequently, experience the longest fracture zones. Experimentation has shown that such formations generally contain the higher permeability sands and will be the best producing formations.

The foregoing described method of the present invention provides for effective fracturing of a plurality of hydrocarbon-bearing formations over a long interval in a single fracturing operation. Such method produces near-optimum distribution of the fracturing materials to the various formations.

It can therefore be seen that the present invention provides an effective method for the fracturing of a plurality of hydrocarbon-bearing formations traversed by a well in a single fracturing operation when the pressure increases during previous and individual fracturing of such formations in nearby wells in the producing area are known to exhibit at least a minimum difference in the instantaneous shut-in pressure at the start and at the end of the fracturing treatment of each such formation.

We claim:

1. A method for forming fractures in a plurality of vertically disposed hydrocarbon-bearing formations communicating with a well equipped with a casing penetrating a subterranean earth formation, comprising the stes of:

(a) identifying those hydrocarbon-bearing formations penetrated by said well casing that exhibited at least a predetermined minimum pressure increase during previous individual fracturing treatments in other nearby production wells in the area, (b) forming perforations in said well casing at the locations of said identified hydrocarbon-bearing formations, and (c) applying hydraulic pressure through said perforations to said plurality of hydrocarbon-bearing formations simultaneously, whereby each of said identified hydrocarbon-bearing formations is fractured in proportion to the pressure increase in each of said hydrocarbon-bearing formations during the application of said hydraulic pressure.

2. The method of claim 1 wherein each of said identified hydrocarbon-bearing formations exhibited pressure increases of at least 500 pounds per square inch during previous individual fracturing in nearby wells.

3. The method of claim 2 wherein each of said pressure increases is the difference in the instantaneous shut-in pressure at the start and end of the individual fracturing operations.

4. The method of claim 1 wherein said hydraulic pressure is generated by a pumping rate of at least 5 barrels per minute with a gelled fracturing fluid having viscometric properties such that the propping material to be used does not settle at a rate exceeding 0.1 foot per second when mixed with the fracturing fluid.

* * * * *